United States Patent [19]

Dillon

[11] Patent Number: 5,025,501

[45] Date of Patent: Jun. 25, 1991

[54] MEDICAL GARMENT AND METHOD FOR MANUFACTURING THE SAME

[76] Inventor: John L. Dillon, 397 La Mirada, El Paso, Tex. 79923

[21] Appl. No.: 455,581

[22] Filed: Dec. 22, 1989

[51] Int. Cl.[5] ..... A41D 13/00

[52] U.S. Cl. ..... 2/51; 2/69; 2/243 B; 2/243 R; 2/DIG. 7

[58] Field of Search ..... 2/DIG. 7, 51, 114, 69, 2/83, 243 B, 243 R, 115, 116, 119

[56] References Cited

U.S. PATENT DOCUMENTS

| | | | |
|---|---|---|---|
| 2,556,039 | 6/1951 | Landert | 2/119 |
| 3,078,467 | 2/1963 | Artzt | 2/114 |
| 3,229,305 | 1/1966 | Nevitt | 2/114 |
| 3,720,957 | 3/1973 | Patience | 2/114 |
| 3,745,587 | 7/1973 | Bradley . | |
| 3,911,499 | 10/1975 | Benevento et al. . | |
| 3,935,596 | 2/1976 | Allen, Jr. et al. . | |
| 4,017,909 | 4/1977 | Brandriff | 2/114 |
| 4,078,265 | 3/1978 | Condit | 2/115 |
| 4,214,320 | 7/1980 | Belkin | 2/114 |
| 4,453,274 | 6/1984 | Allen | 2/115 |
| 4,473,908 | 10/1984 | Knecht | 2/114 |
| 4,535,481 | 8/1985 | Ruth-Larson et al. | 2/114 |
| 4,587,671 | 5/1986 | Rodriguez, Jr. et al. . | |
| 4,608,719 | 9/1986 | Lunt . | |
| 4,631,756 | 12/1986 | Scrivens | 2/114 |
| 4,736,467 | 4/1988 | Schwarze et al. | 2/114 |
| 4,852,187 | 8/1989 | Johansson | 2/114 |

*Primary Examiner*—William A. Cuchlinski, Jr.
*Assistant Examiner*—William C. Dowling
*Attorney, Agent, or Firm*—Curtis, Morris & Safford

[57] ABSTRACT

In order to maximize protection against bacteria, this medical garment includes a double front. The medical garment includes a sleeve portion having first and second main sleeves extending continuously from the neck opening to an outer edge thereof. A first body portion of the garment has a first front panel extending continuously from the neck portion downwardly to a first bottom edge thereof, and a rear panel extending from the neck opening to the first bottom. A second body portion is secured to the rear panel and has a second front panel overlying the first front panel to provide the aforementioned double-layered front form the garment. The second front panel runs continuously from the neck opening to a second bottom edge thereof which is not attached to the first front panel such that an open passageway is formed between the first and second front panels to provide an added protective air space layer. Additionally, since predominantly straight line cuts are made in the original blank, the assembly of the medical garment is conducive to a folding process as well as ultrasonic welding of the seams.

55 Claims, 6 Drawing Sheets

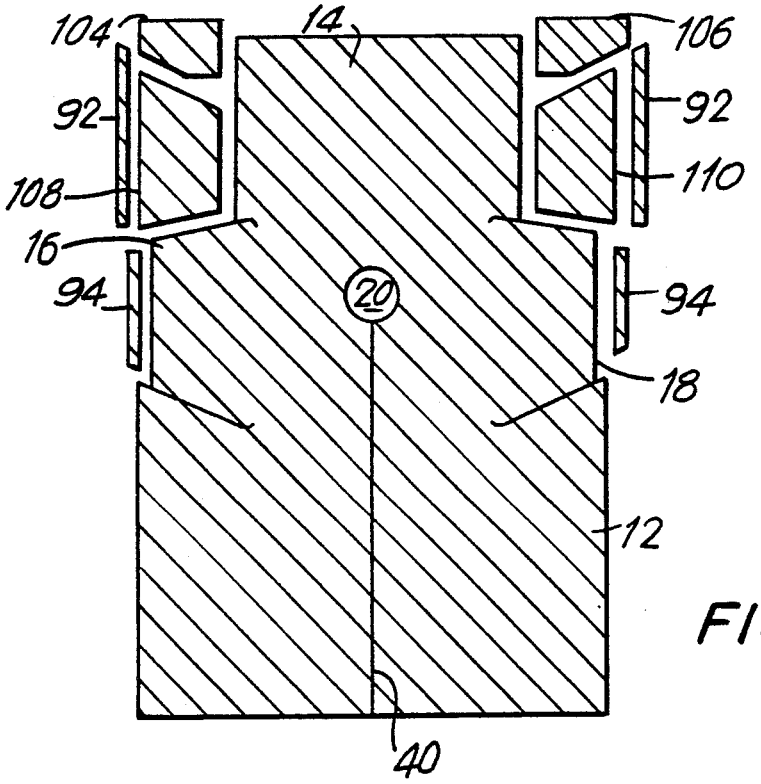
FIG. 3
FIG. 4
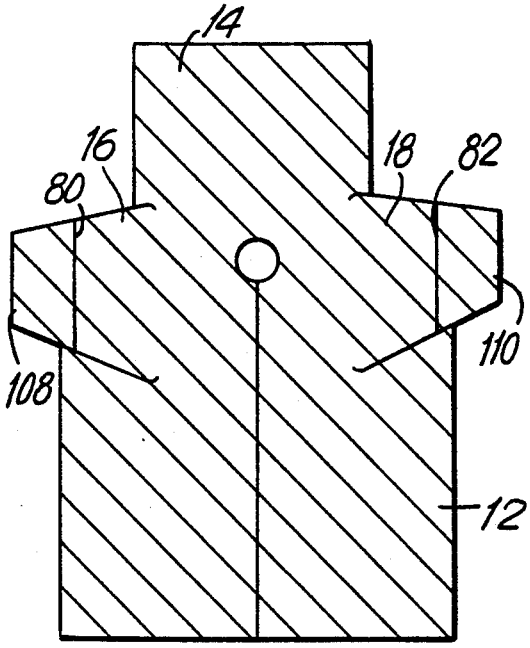
FIG. 5
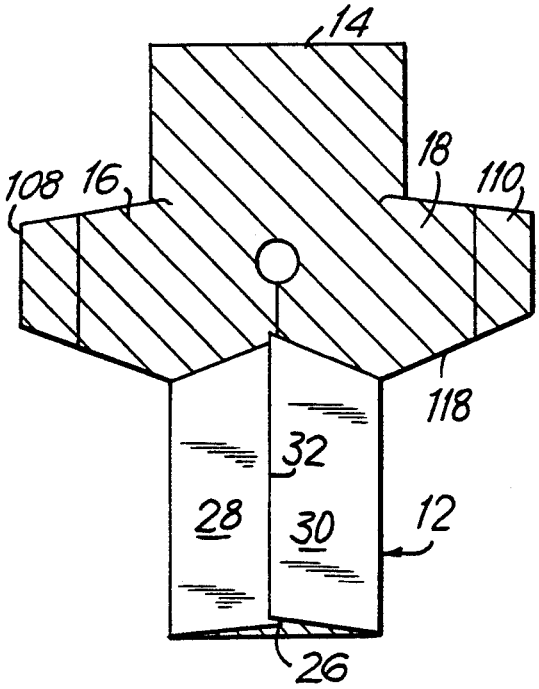

MEDICAL GARMENT AND METHOD FOR MANUFACTURING THE SAME

BACKGROUND OF THE INVENTION

This invention relates to the field of garments and a method of manufacturing the same, and more particularly, to a medical garment of lightweight material formed from a single blank and a method for manufacturing same.

As background, manufacturing a hospital garment from a single blank is known. Representative of such a manufacturing process is U.S. Pat. No. 3,911,499 to Benevento et al. It is also known based on Benevento to cut material from the blank which is used subsequently as an overlap in the back panel of the gown. The blank used in Benevento, however, is not of a standard rectangular configuration and does not utilize substantially all of the material cut-off from the blank. In order to assemble the Benevento gown, curvilinear cuts are made in the Benevento blank. These non-straight cuts, however, are not conducive to manufacturing the gown, primarily by a folding process.

The hospital gown in Benevento is described as being formed by an unbroken single front panel and seams extending from the armpit underneath the sleeves to the cuffs and across the back. The Benevento gown is not, however, suitably protective against bacteria as well as adequately reinforced for today's lightweight materials used in this type of garment. It is, therefore, advantageous to provide a hospital garment which not only is protective against bacteria, i.e. impervious as the fabric used, but also adequately reinforced to provide sufficient garment strength.

Ultrasonic welding of specific medical garment seams is also known. For example, U.S. Pat. No. 4,608,719 to Lunt, Jr. et al. discloses a disposable medical gown wherein the margins of the rear fold is ultrasonically seamed to the upper edges of the notches to create outstretched sleeves and to the upper edges of the rear flaps to form the rear panel of the gown which can be slipped over the head of the wearer. Hospital gowns such as the Lunt gown have also been found to be disadvantageous as they do not provide for adequate reinforcement. Furthermore, cuts made in the generally rectangular blank in Lunt are not subsequently used as component parts of the gown, thus leading to material waste which thereby further increases costs.

OBJECTS OF THE INVENTION

Therefore, it is an object of the present invention to provide a medical garment and method for manufacturing the same which avoids the aforementioned disadvantages of the prior art.

An additional object of this invention is to provide a disposable medical garment which is reinforced and as impervious as the fabric used.

A further object of this invention is to reduce the labor intensity in the manufacturing of the medical garment.

A further object of this invention is to provide a method of manufacturing a medical garment which allows the garment to be assembled primarily by a folding process which is less labor intensive.

Another object of this invention is to provide a medical garment pattern configuration that is composed predominantly of straight lines, and accordingly, is conducive to ultrasonic assembly and assembly by a folding process.

A further object of this invention is to provide a method of manufacturing a medical garment which reduces fabric waste.

Various other objects, advantages and features of the present invention will become readily apparent from the ensuing detailed description, and the novel features will be particularly pointed out in the appended claims.

SUMMARY OF THE INVENTION

In accordance with the present invention, an improved disposable medical garment formed of a lightweight material is provided. The medical garment includes sleeve portions each having first and second main sleeves extending continuously from the neck opening to an outer edge thereof.

In accordance with one of the general objects of the invention, the disposable medical garment includes a double-paneled front to increase the wearer's protective against bacteria. The garment includes a first body portion having a first front panel extending continuously from the neck opening downwardly to a first bottom edge thereof and a rear panel extending from the neck portion to the first bottom edge. A second body portion is secured to the rear panel and has a second front panel which overlies the first front panel to provide the aforementioned double-layered front. The second front panel runs continuously from the neck opening to a second bottom edge thereof which is substantially above the first bottom edge and is not attached to the first front panel to thereby form an open passageway between the first and second front panel which provides an additional air space to protect against bacteria.

In accordance with another specific objective of the invention, plural reinforcements are incorporated within the medical garment of the present invention to provide a medical garment which is resistant to tearing and as impervious as the fabric or material used. The first front panel includes first and second front folded sections forming the front reinforcement, the second front panel includes first and second side reinforcements joined to the rear panel, and a sterile back placket joined to the rear panel adjacent to the neck opening.

A method of manufacturing a medical garment from a single generally rectangular blank is also provided. In accordance with a general object of the present invention, this method employs predominantly straight-line cuts in the original blank such that assembly is primarily a folding process, and moreover, is conducive to ultrasonic welding. Additionally, these straight-line cuts provide for reduced waste of the fabric as material cut-off from the original blank is subsequently used as component parts of the garment as will be described in more detail below. In this method, a neck opening is cut from the blank. Furthermore, first and second straight fold lines are cut from each side edge of the blank wherein the first fold lines are cut above the second fold lines such that the main sleeve portions are formed between the first and second fold lines, the first body portion is formed below the second fold lines and the second body portion is formed above the first fold lines.

The first body portion is folded along the second fold lines to provide a first front panel having first and second front folded sections and a rear panel. The first and second front folded sections are then joined forming the front reinforcement. The second body portion and main sleeve portions are then folded rearwardly along a third fold line such that each sleeve portion has a front member and a rear member which are subsequently joined forming the front reinforcement. The sleeve portions are then moved through the arm hole gap thereby turning the garment such that said second body portion overlies the first front panel. The second body portion (including first and second side reinforcements) is joined to the rear panel such that the open passageway is formed between the first front panel and the second body portion.

In accordance with yet another object of this invention, this method reduces fabric waste in cutting and assembly of the garment. Pursuant thereto, certain material portions cut-off from the original blank are subsequently used as component parts of the garment. These include the sleeve bottoms, sterile back placket, and first and second belts. Accordingly, approximately 99% of the generally rectangular original blank is used in the finished medical garment.

BRIEF DESCRIPTION OF THE DRAWINGS

The following detailed description, given by way of example, will best be understood in connection with the accompanying drawings in which:

FIGS. 3 through 13 are front elevational views illustrating subsequent steps in the manufacturing of the medical garment of FIG. 1.

DETAILED DESCRIPTION OF A PREFERRED EMBODIMENT

Figure 1:
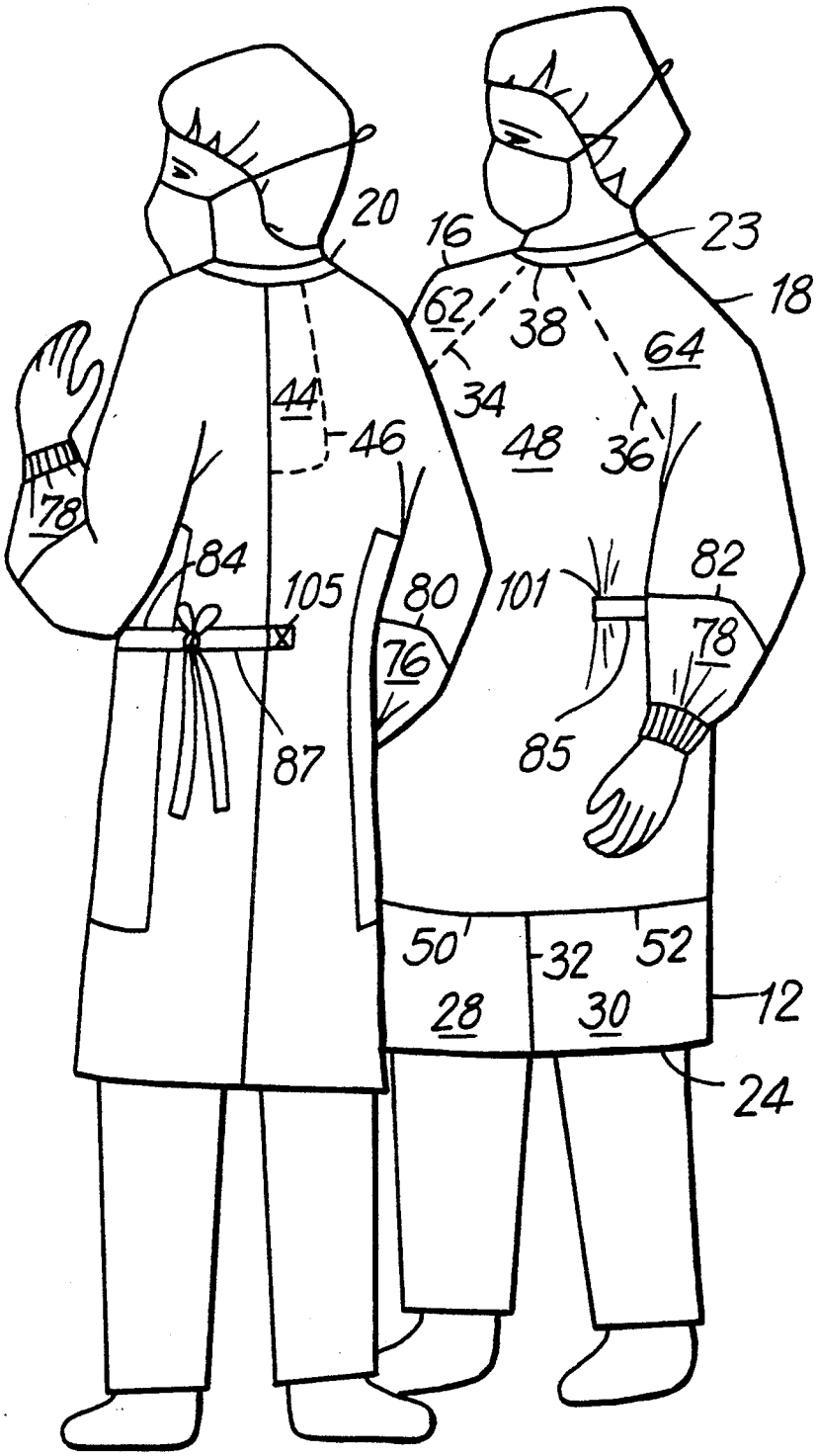
FIG. 1 is a combined front and rear perspective views of a preferred embodiment of the medical garment in accordance with the present invention in use.
Figure 12:
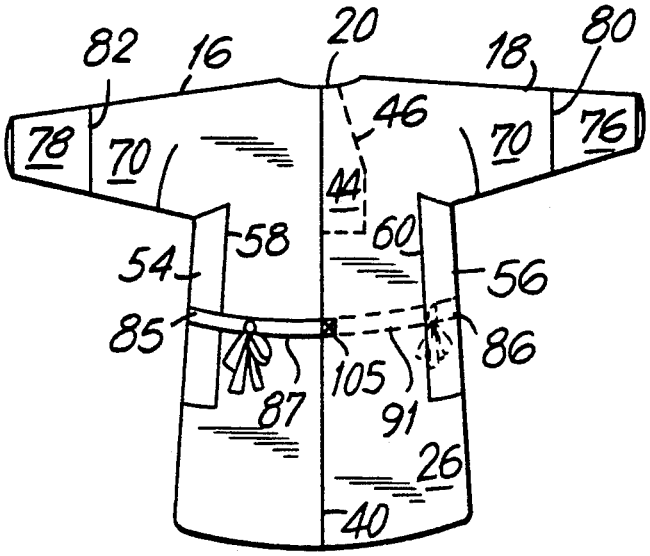
Figure 13:
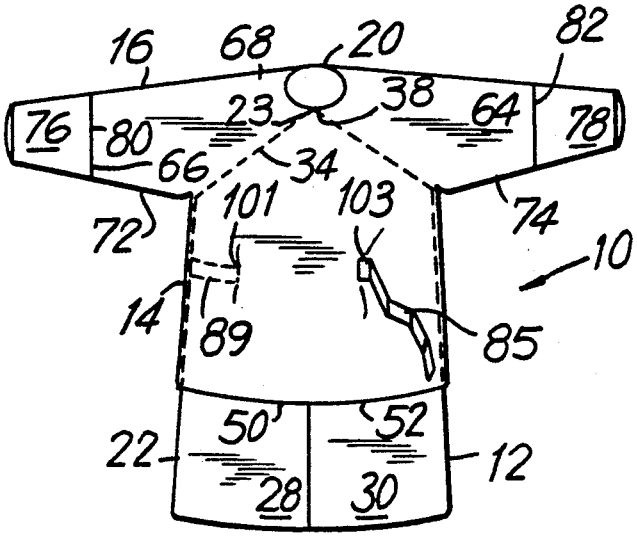

Referring now to the drawings, wherein like reference numerals are used throughout, and in particular to FIGS. 1 and 12–13, there is illustrated a preferred embodiment of a disposable medical garment 10 in accordance with the present invention. This medical garment can be used by either the patient or the attending medical staff, preferably as a medical gown. The medical gown is made of a lightweight material, preferably a non-woven material consisting of at least about 60% polyester and weighing approximately 1½ to 2 ounces per square yard. The use of the garment, however, is not restricted to medical environments.

As shown in FIG. 1, the medical garment includes a first body portion 12, a second body portion 14, main sleeve portions 16 and 18, and a neck opening 20. The first body portion includes a first front panel 22 extending continuously from the neck portion 23 downwardly to a first bottom edge 24 thereof. The first body portion also includes a rear panel 26 (see FIG. 12) extending from neck portion 23 to first bottom edge 24.

In order to resist tearing of the first front panel, the first front panel is composed of first and second front folded sections 28 and 30 joined along seam 32 defining a front reinforcement which is preferably ultrasonically welded or glued. First front folded section 28 has a generally upwardly extending top surface 34 and second front folded section 30 has a generally downwardly extending top surface 36. These top surfaces are joined at an apex 38 along seam 32 which is preferably welded or glued.

The rear panel 26 has an open slit 40 along generally the mid-line 42 thereof to allow easy access into the garment by the wearer. In order to reinforce the rear panel and to protect the neck portion against bacteria, a generally trapezoidal-shaped sterile back placket 44 is joined by ultrasonic welding to the rear panel along seam 46 adjacent to the neck opening 20.

In accordance with one of the specific objects of the invention, the medical garment herein includes a double-layered front which increases protection against bacteria. To provide this double-layered front, second body portion 14 includes a second front panel 48 which overlies the first front panel 22 and runs continuously from neck portion 23 to a second bottom edge 50 thereof which is substantially above first bottom edge 24 of first front panel 22. Accordingly, an open passageway 52 is formed between the first and second front panels which provides an additional air space to protect against bacteria.

The problem associated with tears in the second front panel is significantly alleviated in that it is reinforced. The second body portion includes first and second side reinforcements 54 and 56 (see FIG. 12) which are formed integrally with the second front panel 48. The first and second side reinforcements are joined to rear panel 26 by preferably ultrasonic spot welding or spot gluing seams 58 and 60, respectively. Furthermore, in order to provide further rigidity to the medical garment, in an alternative embodiment, apex 38 of the first front panel 22 is secured to the second front panel 48 adjacent to neck opening 20.

Each main sleeve portion 16 and 18 of the garment has first and second main sleeves 62 and 64. These main sleeves extend continuously from neck portion 23 to an outer edge, such as 66 thereof, on opposite sides of the neck opening. Each of the main sleeves has a front member 68 formed integrally with the second front panel 48 and a rear member 70 formed integrally with the rear panel 26. The front and rear members of the first main sleeve 62 are joined along seam 72. The front and rear members of the second main sleeve 64 are joined along seam 74. Seams 72 and 74 are preferably welded ultrasonically or glued. The main sleeve portions 16 and 18 also include generally pentagonal-shaped first and second sleeve bottoms 76 and 78, respectively, which are joined to the outer edges 66 of the respective main sleeves along seams 80 and 82. Accordingly, the medical garment of the present invention provides for full-length sleeves.

In order to closely confine the garment to the body of the wearer, a first belt 84 is provided (see FIGS. 10 and 11) having one segment 85 being attached to the outer surface of the second front panel 48 at point 101 and a second segment 87 of generally the same length as segment 85 being attached to the exterior surface of rear panel 26 at generally the center back thereof adjacent to the mid-line 42. At crimp point 101, the first and second front panels are anchored together. These two segments 85 and 87, when tied, aid in closely confining the garment to the body of the wearer. Similarly, a second belt 86 is provided (see FIG. 12) having a first portion 89 attached to the interior surface of first front panel at crimp point 103 and a second portion 91, generally the same length as first portion 89, attached to the interior surface of the rear panel at generally the center back 105 thereof adjacent to the mid-line 42. The first and second portions 89 and 91 are shorter in length than the first and second segments 85 and 87 of the first belt. The first and second front panels are anchored together at crimp point 103. The first and second portions 89 and 91, when tied cooperate with the tied first belt to close the open slit and closely confine the garment around the body of the wearer.

Figure 2:
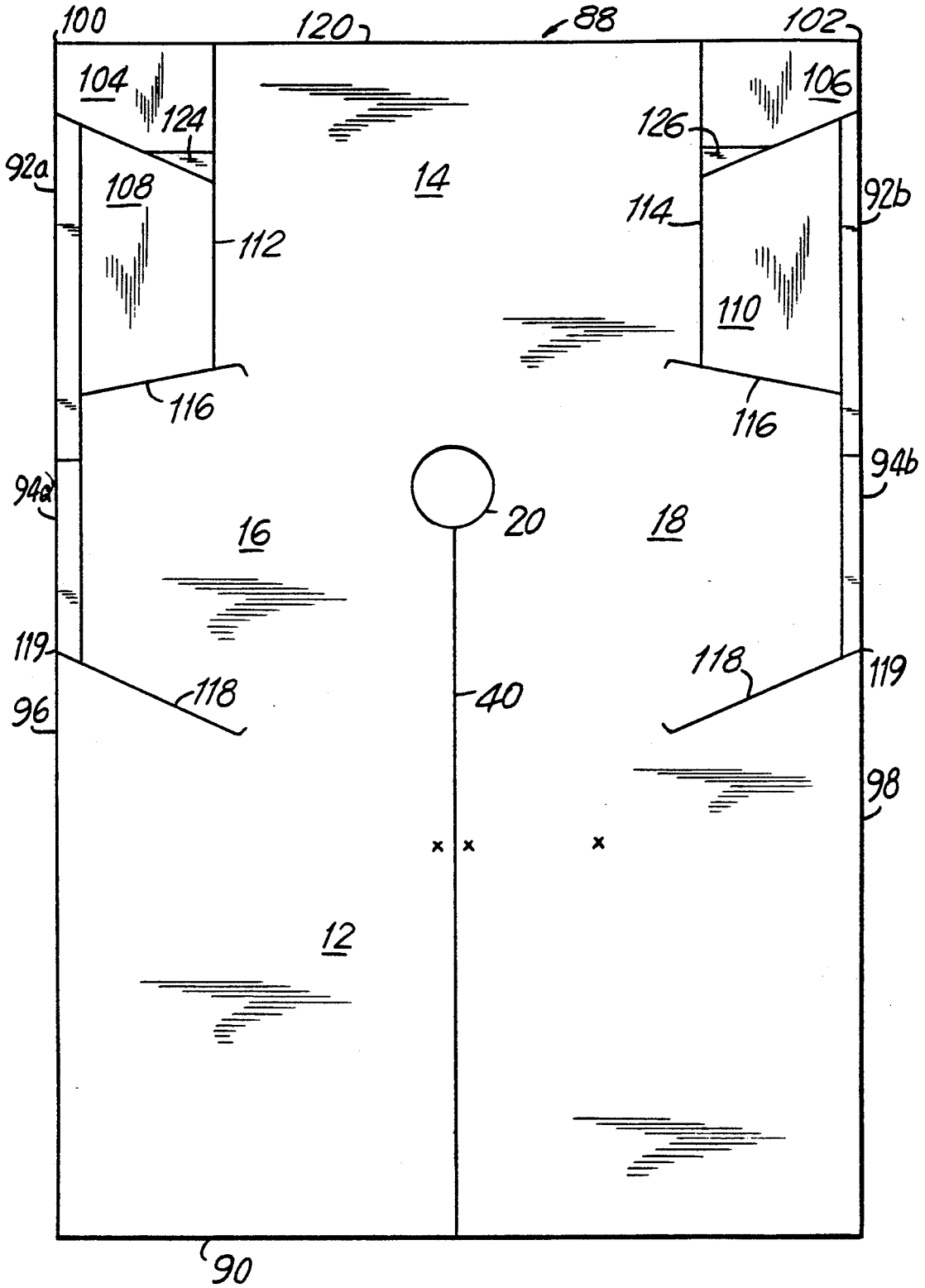
FIG. 2 is a top elevational view of the first step in manufacturing the medical garment of FIG. 1 illustrating the initial cuts made in a generally rectangular single blank of material.

Referring now to FIGS. 2–13, a method of manufacturing a medical garment is set forth. In the preferred embodiment, this method manufactures the medical garment illustrated in FIG. 1, but other medical garment designs can be assembled by this method. As shown in FIG. 2, a generally rectangular single blank 88 of lightweight material is utilized. As aforementioned, the preferred lightweight material is preferably a non-woven material consisting of at least about 60% polyester and weighing approximately 1½ to 2 ounces per square yard. The blank is composed of approximately 3.3 to 3.5 square yards of material.

In this process, a neck opening 20 is cut in the blank. Other than the neck opening, the cuts made in the blank are straight, and thus, in subsequent steps aid in the folding process of the garment. The vertically aligned open slit 40 is cut in the blank from the neck opening 20 to the lower edge 90 of the blank. As shown in FIGS. 2 and 3, a plurality of component parts are cut in straight lines from the blank which will be subsequently used as component parts of the garment. These cutouts include a first and second pair of slender members 92*a* and *b* and 94*a* and *b*, respectively, cut from the sides 96 and 98 of blank 88. A pair of third members 104 and 106, which are generally pentagon-shaped, are cut from the upper corners 100 and 102, respectively, of the blank 88. These pentagon-shaped members 104 and 106 are cut from the blank adjacent to the first pair of slender members 92. Furthermore, a pair of generally trapezoidal-shaped members 108 and 110 are cut from each side of the blank juxtaposed to the cuts made for the members 104 and 106 and the first slender members 92*a* and *b*. As illustrated in FIGS. 2–3, these cut-out members 92*a* and *b*, 94*a* and *b*, 104, 106, 108, 110 are all cut out from the blank in straight lines.

Additionally, a generally straight upwardly extending fold line 116 is cut from the edges of the blank. This separates the main sleeve portions 16 and 18 of the blank from the second body portion 14. Similarly, a generally straight downwardly extending fold line 118 is cut from the side edges of the blank between the sleeve portions 16 and 18 and the first body portion 12. Finally, a pair of generally parallel vertically aligned straight slits 112 and 114 are cut from the upper edge 120 of the blank to each of the first fold lines 116 to define side surfaces of second body portion 14. As shown in FIG. 3, after these cuts have been made, only the first body portion 12, second body portion 14, main sleeve portion 16 and 18, neck opening 20 and open slit 40 remain in the blank.

As shown in FIG. 4, each of the trapezoidal-shaped members 108 and 110 are joined to one of the main sleeve portions 16 and 18 along seams 80 and 82 to thereby provide sleeve bottoms 76 and 78. The seams 80 and 82 are preferably ultrasonically welded or glued.

Referring to FIG. 5, the first body portion 12 is then folded along the downwardly extending fold lines 118 to provide the first front panel 22 having first and second front folded sections 28 and 30 and a rear panel 26. The first and second front folded sections 28 and 30 are joined along their leading edges by seam 32 forming a first front reinforcement. Preferably, seam 32 is welded ultrasonically or glued.

Figure 6:
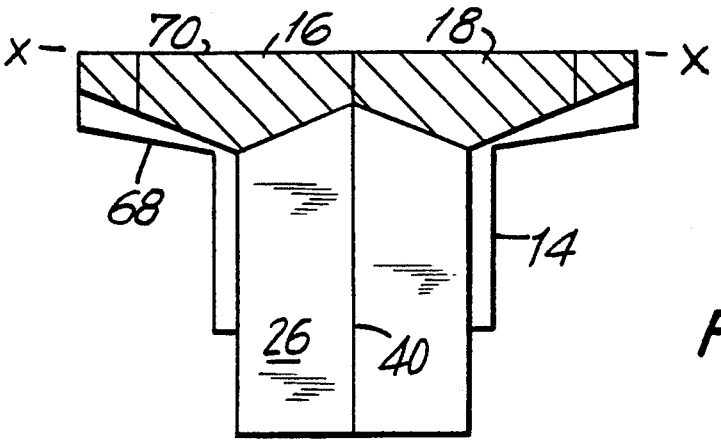

As shown in FIG. 6, the garment is folded in half at the shoulder sections (i.e. the second body portion and main sleeve portions 16, 18) rearwardly along the horizontal axis x—x of neck opening 20 such that the sleeve portions are each formed of a front member 68 and rear member 70.

Figure 7:
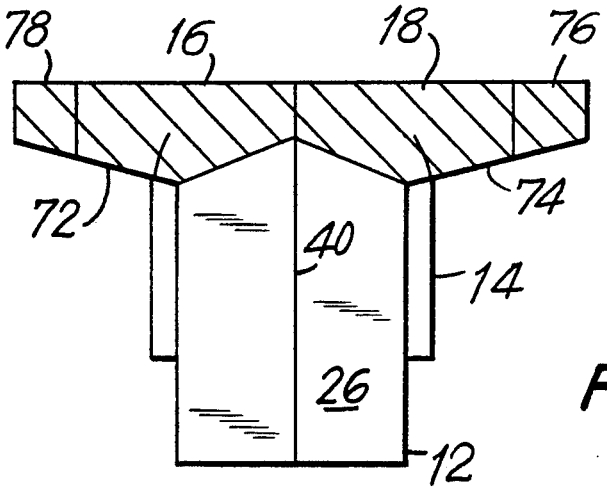

Referring now to FIG. 7, the front and rear members 68 and 70 of each of the main sleeve portions 16 and 18 are joined along seams 72 and 74. Preferably, seams 72 and 74 are welded ultrasonically or glued.

Figure 8:
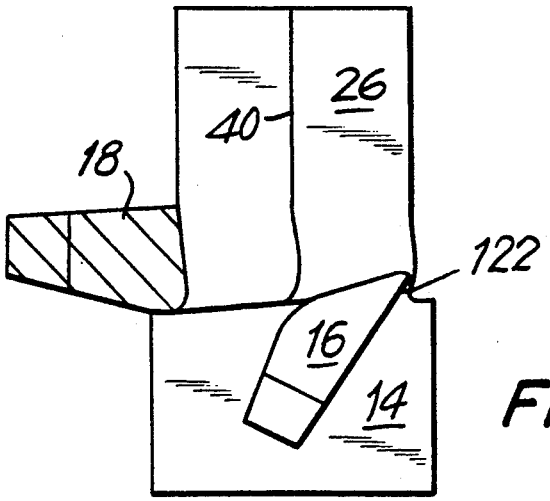

As shown in FIG. 8, the sleeve portions 16 and 18 are pulled through the arm hole gap 122 formed between the first front panel 22 and the second body portion 14. After the sleeve portions have been pulled therethrough, the second front panel 48 of the second body portion overlies the first front panel 26 (see FIG. 13).

Figure 9:
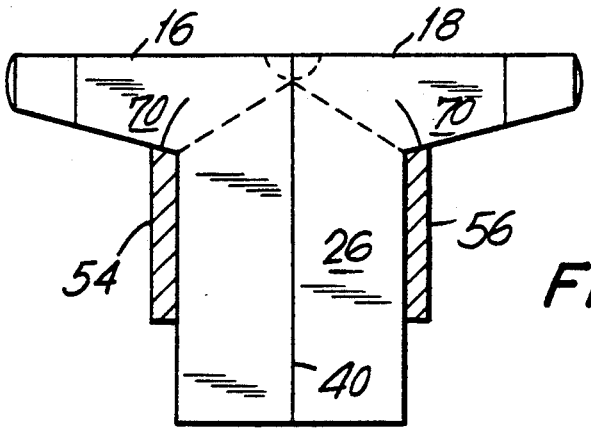
Figure 10:
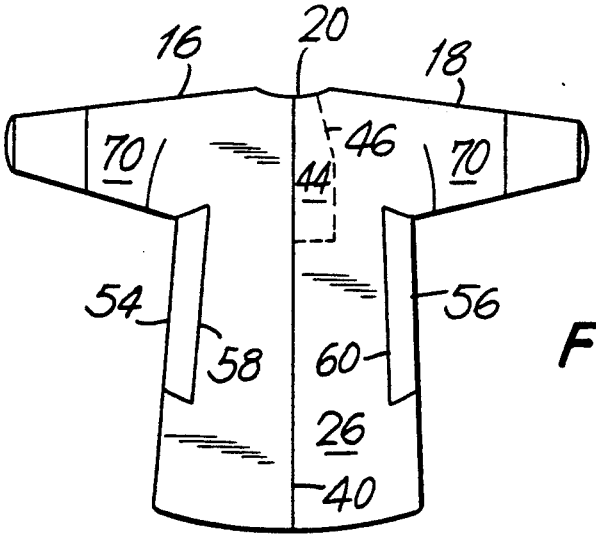

As shown in FIGS. 9 and 10, the first and second side reinforcements, 54 and 56, respectively, of the second body portion 14 are joined to the rear panel 26 along seams 58 and 60, respectively. Preferably, seams 58 and 60 are ultrasonically spot welded or glued. Moreover, as shown in FIG. 10, the pentagon-shape cut-out members 104 and 106 are joined to the neck portion 23 of the rear panel 26 along seam 46 to provide a sterile back placket 44. Preferably, seam 46 is ultrasonically welded or glued.

In order to fold the garment into the configuration illustrated in FIG. 9, downwardly extending fold lines 118, especially the starting point 119 and angle at which the fold line 118 extends downwardly toward the mid-line 40, are advantageously cut from the original blank. This cut is preferably made such that when the first front panel is folded (see FIG. 5) and the sleeve portions 16 and 18 are pulled through the arm hole gap (see FIG. 8), the apex 38 of the generally upward extending top surface 34 and downwardly extending top surface 36 is provided adjacent to the neck opening.

Figure 11:
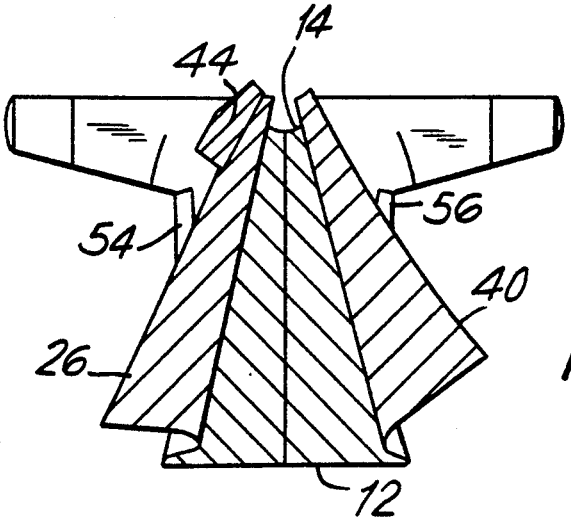

Referring now to FIG. 11, the open slit 40 of rear panel 26 is opened such that the apex 38 of the first front panel 22 is joined to the second front panel 48 at the neck portion thereof.

Subsequent thereto, and as illustrated in FIG. 12, one of the first slender members 92*a* cut-out from the original blank (FIG. 2) is attached to the outer surface of the second front panel 48 as segment 85 at crimp point 101 (FIGS. 1, 2 and 13) and the other of the first slender members 92*b* (FIG. 2) is attached to the exterior surface of rear panel 26 as segment 87 at generally the center back 105 thereof adjacent to the mid-line 42 (see FIG. 13). At crimp point 101, the first and second front panels are anchored together. These two segments 85 and 87, when tied, form a first belt 84 which aids in closely confining the garment to the body of the wearer. Similarly, one of the second slender members 94*a* is attached to the interior surface of the first front panel as first portion 89 at crimp point 103 (see FIG. 13) and the other of the second slender members 94*b* is attached to the interior surface of the rear panel 26 as second portion 91 at generally the center back 105 thereof adjacent to the mid-line 42. The first and second front panels also are anchored together at crimp point 103. The first and second section, when tied forms a second belt 86, which cooperates with the first belt to close the open slit 40 and confine the garment to the body of the wearer.

Based upon the foregoing, applicant has developed a method of manufacturing a medical garment wherein four components cut-out from the original blank 88 are utilized as subsequent parts of the finished medical garment. The only portions of the original blank not utilized in the finished medical garment are the generally triangular cut-out members 124 and 126 see FIG. 2). Accordingly, a method of manufacturing a medical garment outlined herein utilizes over 99% of the material of the original blank, and thus, fabric waste is minimal. Since the blank is cut in predominantly straight lines, the assembly is primarily a folding process, and moreover, the manufacture of the garment is conducive to ultrasonic welding of the seams. The configuration of the medical garment also permits it to be assembled similar to a flat piece of cardboard folding into a box. Furthermore, applicant's hospital garment is reinforced along the front, rear and neck portions thereof such that it not only is as impervious as the fabric utilized but it is also resistant against tearing.

While the invention has been particularly shown and described with reference to a preferred embodiment, it will be readily appreciated by those of ordinary skill in the art that various changes and modifications may be made therein without departing from the spirit and scope of the invention. For instance, certain of the seams of the garment are described as being preferably ultrasonically welded or glued. These seams, however, may additionally be sewn. It is intended that the appended claims be interpreted as including the foregoing as well as various other such changes and modifications.

What is claimed is:

1. A garment having a neck opening comprising:

a sleeve portion having first and second main sleeves extending continuously from the neck opening to an outer edge thereof;

a first body portion having a first front panel extending continuously from the neck portion downwardly to a first bottom edge thereof and a rear panel extending from the neck opening to said first bottom; and a second body portion secured to said rear panel and having a second front panel overlying said first front panel to provide a double-layered front for the garment, said second front panel running continuously from the neck opening to a second bottom edge thereof which is not attached to said first front panel to thereby form an open passageway between said first and second front panels, wherein said sleeve portion and said first and second body portions are formed of unitary construction.

2. The garment of claim 1 wherein said second bottom edge is substantially above said first bottom edge.

3. The garment of claim 1 wherein said first front panel is composed of first and second front folded sections which are joined along a first seam forming a first front reinforcement.

4. The garment of claim 3 wherein said first seam is ultrasonically welded.

5. The garment of claim 3 wherein said first front folded section has a generally upwardly extending top surface and said second front folded section has a generally downwardly extending top surface, and wherein said top surfaces of said first and second front folded sections are joined at an apex along said first seam.

6. The garment of claim 5 wherein said apex is secured to said second front panel adjacent to the neck opening.

7. The garment of claim 1 and further comprising a sterile back placket joined to said rear panel along a second seam adjacent to the neck opening to provide additional protection against bacteria.

8. The garment of claim 7 wherein said second seam is ultrasonically welded.

9. The garment of claim 7 wherein said second seam is glued.

10. The garment of claim 1 wherein said second body portion includes first and second side reinforcements formed integrally with said second front panel.

11. The garment of claim 10 wherein said first and second side reinforcements are joined to said rear panel along third and fourth seams, respectively.

12. The garment of claim 11 wherein said third and fourth seams are ultrasonically welded.

13. The garment of claim 11 wherein said third and fourth seams are glued.

14. The garment of claim 1 wherein each said main sleeve has a front member formed integrally with said second front panel and a rear member formed integrally with said rear panel and wherein said front and rear members of said first main sleeve are joined along a fifth seam and said front and rear members of said second main sleeve are joined along a sixth seam.

15. The garment of claim 14 wherein said fifth and sixth seams are ultrasonically welded.

16. The garment of claim 14 wherein said fifth and sixth seams are glued.

17. The garment of claim 1 and further comprising first and second sleeve bottoms being joined to the outer ends of said first and second main sleeves, respectively, along seventh and eighth seams, respectively thereof.

18. The garment of claim 17 wherein said seventh and eight seams are ultrasonically welded.

19. The garment of claim 17 wherein said seventh and eighth seams are glued.

20. The garment of claim 1 wherein said rear panel includes an open slit along generally the mid-line thereof to allow easy access into the garment.

21. The garment of claim 20 and further including means for closing said open slit.

22. The garment of claim 21 wherein said means for closing said open slit includes first belt means and second belt means which when tied closes said open slit and confines the garment to the body of the wearer.

23. A garment having a neck opening comprising:

a first body portion having a first front panel extending continuously from the neck opening downwardly to a first bottom edge thereof and a rear panel extending from the neck opening to said first bottom edge, said first front panel being composed of first and second front folded sections which are joined by a first seam forming a front reinforcement, said first front folded section having a generally upwardly extending top surface and said second front folded section having a generally downwardly extending top surface, said top surfaces of said first and second reinforcements being joined at an apex along said first seam, said rear panel having an open slit along generally the mid-line thereof to allow easy access into the garment, said rear panel also having a sterile back placket joined thereto along a second seam adjacent to the neck opening;

a second body portion having a second front panel overlying said first front panel to provide a double-layered front to the garment, said second front panel running continuously from the neck opening to a second bottom edge thereof which is substantially above said first bottom edge and is not attached to said first front panel to thereby form an open passageway between said first and second front panels said second body portion having first and second side reinforcements formed integrally with said second front panel which are joined to said rear panel along third and fourth seams, respectively, and said apex being secured to said second front panel adjacent to the neck opening;

a sleeve portion having first and second main sleeves extending continuously from the neck opening to an outer edge thereof, each said main sleeve having a front member formed integrally with said second front panel and a rear member formed integrally with said rear panel, said front and rear members of said first main sleeve are joined along a fifth seam and said front and rear members of said second main sleeve are joined along a sixth seam, said sleeve portion also including first and second sleeve bottoms which are joined to the outer ends of said respective main sleeves along a seventh and eight seams, respectively, thereof; and first belt means and second belt means which when tied closes said open slit and closely confine the garment to the body of the wearer; and

24. The garment of claim 23 wherein all the seams are ultrasonically welded.

25. A method of manufacturing a garment from a single generally rectangular blank comprising the steps of:

cutting a neck opening in the blank;

cutting first and second fold lines from each side edge of the blank wherein said first fold lines are above the second fold lines such that a pair of main sleeve portions are formed between said first and second fold lines, a first body portion is formed below said second fold lines and a second body portion is formed above said first fold lines;

folding said first body portion along said second fold lines to provide a first front panel having first and second front folded sections and a rear panel;

joining said first and second front folded sections;

folding said second body portion and main sleeve portions rearwardly along a third fold line such that each main sleeve portion has a front member and a rear member;

joining said front and rear members of said sleeve portions;

moving said sleeve portions through an arm hole gap formed between said first and second front panels to turn the garment such that said second body portion overlies said first front panel; and joining said second body portion to said rear panel such that an open passageway is formed between said first front panel and said second body portion.

26. The method of manufacturing a garment of claim 25 wherein said first and second front folded sections are joined by ultrasonic welding.

27. The method of manufacturing a garment of claim 25 wherein said first and second front folded sections are joined by gluing.

28. The method of manufacturing a garment of claim 25 wherein said front and rear members of said pair of main sleeve portions are joined by ultrasonic welding.

29. The method of manufacturing a garment of claim 25 wherein said front and rear members of said pair of main sleeve portions are joined by gluing.

30. The method of manufacturing a garment of claim 25 wherein said second body portion is joined to said rear panel by ultrasonic welding.

31. The method of manufacturing a garment of claim 25 wherein said second body portion is joined to said rear panel by gluing.

32. The method of manufacturing a garment of claim 25 wherein said third fold line is approximately the horizontal axis of the neck opening.

33. The method of manufacturing a garment of claim 25 and further including cutting a pair of generally parallel vertically aligned slits from the upper edge of the blank to each of said first fold lines to thereby define side surfaces of said second body portion.

34. The method of manufacturing a garment of claim 25 and further including cutting a pair of first, second, third and fourth cut-out members from the blank.

35. The method of manufacturing a garment of claim 34 and further including joining one of said pair of first cut-out members to each of said main sleeve portions to provide sleeve bottoms.

36. The method of manufacturing a garment of claim 35 wherein one of said pair of first cut-out members is joined to each of said main sleeve portions by ultrasonic welding.

37. The method of manufacturing a garment of claim 34 and further including joining said second cut-out members to said rear panel adjacent to said neck opening to provide a sterile back placket.

38. The method of manufacturing a garment of claim 37 wherein said second cut-out members are joined to said rear panel by ultrasonic welding.

39. The method of manufacturing a garment of claim 34 and further including cutting a vertically aligned open slit in the blank from said neck opening to the lower edge of the blank.

40. The method of manufacturing a garment of claim 39 and further including attaching one of said third cut-out members to the outer surface of the second front panel and attaching another of said third cut-out members to the exterior surface of the rear panel to provide a first belt.

41. The method of manufacturing a garment of claim 40 and further including attaching one of said fourth cut-out members to the surface of the first front panel and attaching another of the fourth cut-out members to the interior surface of the rear panel which when tied forms a second belt which cooperates with said tied first belt to close said open slit and closely confine the garment to the body of the wearer.

42. The method of manufacturing a garment of claim 25 and further including joining said first front panel to said second body portion adjacent to said neck opening.

43. A method of manufacturing a garment from a single generally rectangular blank comprising the steps of:

cutting a neck opening in the blank;

cutting a vertically aligned open slit in the blank from said neck opening to the lower edge of the blank;

cutting a pair of first, second, third and fourth cut-out members from the blank;

cutting first and second fold lines from each side edge of the blank wherein said first fold lines are above said second fold lines such that a main sleeve portion is formed between said first and second fold lines, a first body portion is formed below said second fold lines and a second body portion is formed above said first fold lines;

cutting a pair of generally parallel vertically aligned slits from the upper edge of the blank to each of said first fold lines to define side surfaces of said second body portion;

joining one of said pair of first cut-out members to each of said main sleeve portions along first and second seams to provide sleeve bottoms;

folding said first body portion along said second fold line to provide a first front panel having first and second front folded sections and a rear panel;

joining said first and second front folded sections along a third seam;

folding said second body portion and main sleeve portions rearwardly along the horizontal axis of the neck opening such that each main sleeve portion has a front member and a rear member;

joining said front and rear members of said pair of main sleeve portions along fourth and fifth seams;

moving said sleeve portions through an arm hole gap formed between said first and second front panels to turn the garment such that said second body portion overlies said first front panel;

joining first and second side reinforcements of said second body portion to said rear panel along sixth and seventh seams, respectively;

joining said second cut-out members to said rear panel adjacent to said neck opening along an eighth seam to provide a sterile back placket;

joining said first front panel to said second body portion adjacent to said neck opening;

attaching one of said third cut-out members to the outer surface of the second front panel and attaching another of said third cut-out members to the exterior surface of the rear panel to provide a first belt; and attaching one of said fourth cut-out members to the interior surface of the first front panel and attaching another of the fourth cut-out members to the interior surface of the rear panel which when tied forms a second belt which cooperates with said tied first belt to close said open slit and closely confines the garment to the body of the wearer.

44. The method of manufacturing a garment of claim 43 wherein all of said seams are ultrasonically welded.

45. The method of manufacturing a garment of claim 43 wherein said pair of first cut-out members are generally trapezoidal in shape.

46. The method of manufacturing a garment of claim 43 wherein said pair of second cut-out members are generally pentagonal in shape.

47. The method of manufacturing a garment of claim 43 wherein said third and fourth cut-out members are generally long slender members.

48. The method of manufacturing a garment of claim 43 wherein said first fold lines generally upwardly extend from the side edges of the blank.

49. The method of manufacturing a garment of claim 43 wherein said second fold lines generally downwardly extend from the side edges of the blank.

50. A method of manufacturing a garment from a single generally rectangular blank comprising the steps of:

cutting a neck opening in the blank;

cutting a vertically aligned open slit in the blank from said neck opening to the lower edge of the blank;

cutting a plurality of component parts from the blank such that the blank includes a first body portion, a second body portion, a pair of main sleeve portions, said neck opening and said open slit;

cutting generally upwardly extending fold lines from the side edges of the blank between said sleeve portions and said second body portion;

cutting generally downwardly extending fold lines from the side edges of the blank between said sleeve portions and said first body portion and below said generally upwardly extending fold lines;

joining one of said component parts to each of said main sleeve portions along first and second seams to thereby provide sleeve bottoms;

folding said first body portion along said downwardly extending fold lines to provide a first front panel having first and second front folded sections and a rear panel;

joining said first and second front folded sections along a third seam;

folding said second body portion and said sleeve portions rearwardly along the horizontal axis of said neck opening such that each main sleeve portion has a front member and a rear member;

joining said front and rear members of said pair of main sleeve portions along fourth and fifth seams, respectively;

moving said second body portion and said main sleeve portions through an arm hole gap formed between said first front panels and said second body portion to turn the garment such that a second front panel of said second body portion overlies said first front panel;

joining first and second side reinforcements of said second body portion to said rear panel along sixth and seventh seams, respectively;

joining another of said component parts to said rear panel adjacent to said neck opening along an eighth seam to provide a sterile back placket;

joining said first front panel to said second front panel at the neck portion thereof;

attaching one of said third cut-out members to the outer surface of the second front panel and attaching another of said third cut-out members to the exterior surface of the rear panel to provide a first belt; and attaching one of said fourth cut-out members to the interior surface of the first front panel and attaching another of the fourth cut-out members to the interior surface of the rear panel which when tied forms a second belt which cooperates with said tied first belt to close said open slit and closely confines the garment to the body of the wearer.

51. The method of manufacturing a garment of claim 50 wherein all of said seams are ultrasonically welded.

52. A garment having a neck opening comprising:

a sleeve portion having first and second main sleeves extending continuously from the neck opening to an outer edge thereof;

a first body portion having a first front panel extending continuously from the neck portion downwardly to a first bottom edge thereof and a rear panel extending from the neck opening to said first bottom, said first front panel is composed of first and second front folded sections which are joined along an ultrasonically-welded first seam forming a first front reinforcement, said first front folded section having a generally upwardly extending top surface and said second front foled section having a generally downwardly extending top surface, and a second body portion secured to said near panel and having a second front panel overlying said first front panel to provide a double-layered front for the garment, said second front panel running continuously from the neck opening to a second bottom edge thereof which is not attached to said first front panel to thereby form an open passageway between said first and second front panels, wherein said top surfaces of said first and second front folded sections are joined at an apex along said first seam which is secured to said second front panel adjacent to the neck opening.

53. A garment having a neck opening comprising:

a sleeve portion having first and second main sleeves extending continuously from the neck opening to an outer edge thereof;

a first body portion havign a first front panel extending continuously from the neck portion downwardly to a first bottom edge thereof and a rear panel extending from the neck opening to said first bottom, said rear panel also including a sterile back placket joined thereto along a seam adjacent to the neck opening to provide additional protection against bacteria; and a second body portion secured to said rear panel and having a second front panel overlying said first front panel to provide a double-layered front for the garment, said second front panel running continuously from the neck opening to a second bottom edge thereof which is not attached to said first front panel to thereby form an open passageway between said first and second front panels.

54. A garment having a neck opening comprising:

a sleeve portion having first and second main sleeves extending continuously from the neck opening to an outer edge thereof;

a first body portion having a first front panel extending continuously from the neck portion downwardly to a first bottom edge thereof and a rear panel extending from the neck opening to said first bottom; and a second body portion secured to said rear panel and having a second front panel overlying said first front panel to provide a double-layered front for the garment, said second front panel running continuously from the neck opening to a second bottom edge thereof which is not attached to said first front panel to thereby form an open passageway between said first and second front panels, said second body portion also including first and second side reinforcements formed integrally with said second front panel.

55. A garment having a neck opening comprising:

a sleeve portion having first and second main sleeves extending continuously from the neck opening to an outer edge thereof;

a first body portion having a first front panel extending continuously from the neck portion downwardly to a first bottom edge thereof and a rear panel extending from the neck opening to said first bottom; and a second body portion secured to said rear panel and having a second front panel overlying said first front panel to provide a double-layered front for the garment, said second front panel running continuously from the neck opening to a second bottom edge thereof which is not attached to said first front panel to thereby form an open passageway between said first and second front panels, each said main sleeve having a front member formed integrally with said second front panel and a rear member formed integrally with said rear panel and wherein said front and rear members of said first main sleeve are joined along a seam and said front and rear members of said second main sleeve are joined along another seam.

* * * * *